US012656081B2

(12) United States Patent
Felts

(10) Patent No.: US 12,656,081 B2
(45) Date of Patent: Jun. 16, 2026

(54) FIREARM CARRIER ELEMENT

(71) Applicant: Center Mass, Inc., Livonia, MI (US)

(72) Inventor: Jeffrey Glenn Felts, Canton, MI (US)

(73) Assignee: Center Mass, Inc., Livonia, MI (US)

( * ) Notice: Subject to any disclaimer, the term of this patent is extended or adjusted under 35 U.S.C. 154(b) by 75 days.

(21) Appl. No.: 18/646,691

(22) Filed: Apr. 25, 2024

(65) Prior Publication Data

US 2025/0347491 A1 Nov. 13, 2025

Related U.S. Application Data

(60) Provisional application No. 63/462,321, filed on Apr. 27, 2023, provisional application No. 63/461,919, filed on Apr. 26, 2023.

(51) Int. Cl.
*F41C 33/00* (2006.01)

(52) U.S. Cl.
CPC ..... *F41C 33/007* (2013.01)

(58) Field of Classification Search
CPC ..... F41C 33/006; F41C 33/007
USPC ..... 224/271, 913; D22/108
See application file for complete search history.

(56) References Cited

U.S. PATENT DOCUMENTS 757,343 A * 4/1904 Patterson ..... F41C 33/007 224/927
1,222,264 A * 4/1917 Cabanne ..... F41C 33/0245 224/912
2,873,902 A * 2/1959 Decker ..... F41C 33/007 224/257
6,561,073 B1 * 5/2003 Høgmoe ..... F41C 33/008 89/1.4
D645,930 S * 9/2011 Pearce ..... D22/108
D683,807 S * 6/2013 Elkaim ..... D22/108
8,613,564 B2 * 12/2013 Busch ..... F16B 21/09 403/328
D702,799 S * 4/2014 Coviello ..... D22/108
8,910,410 B2 * 12/2014 Peters ..... F41C 33/006 224/271
8,943,730 B2 * 2/2015 Ascano ..... F41C 33/007 42/94
9,879,943 B2 * 1/2018 Ray ..... F41C 33/003
10,234,226 B1 * 3/2019 Copeland ..... F41A 17/38
10,378,855 B2 * 8/2019 Ray ..... F41C 33/003
10,466,011 B2 * 11/2019 Swan ..... F41C 33/0263
10,753,696 B1 * 8/2020 Christopher ..... F41A 17/42
10,914,554 B2 * 2/2021 Komulainen ..... F41A 23/04
(Continued)

*Primary Examiner* — Justin M Larson
(74) *Attorney, Agent, or Firm* — Bennet K. Langlotz; Langlotz Patent & Trademark Works, LLC

(57) ABSTRACT

A firearm carrier element has a plate having a first side configured to face the supporter and an opposed second side configured to face the firearm, a connection facility configured to connect the plate to the supporter, and an aperture configured to receive at least one of the protrusions and the operating element. The operating element may be a bolt catch lever. The operating element may be movable between a ready position when the firearm is disconnected from the carrier element and a retention position when the firearm is connected to the carrier element. The operating element may be spring biased. The plate may include a ramp surface adjacent the aperture and configured to move the operating element in response connection of the firearm to the carrier element.

12 Claims, 10 Drawing Sheets

(56) References Cited

U.S. PATENT DOCUMENTS

| | | | | |
|---|---|---|---|---|
| 11,168,957 | B2 * | 11/2021 | Cass | F41C 33/0245 |
| 11,385,008 | B2 * | 7/2022 | Markut | F41A 35/06 |
| 11,585,634 | B2 * | 2/2023 | Wessels | F41C 33/007 |
| 12,313,366 | B2 * | 5/2025 | Geissele | F41A 35/06 |
| 2003/0075037 | A1 * | 4/2003 | Hogmoe | F41C 33/0281 89/1.42 |
| 2012/0266352 | A1 * | 10/2012 | Busch | F41C 33/007 403/375 |
| 2013/0276343 | A1 * | 10/2013 | Peters | F41C 33/007 29/469 |
| 2014/0190054 | A1 * | 7/2014 | Ascano | F41C 33/005 42/71.01 |

* cited by examiner

FIREARM CARRIER ELEMENT

CROSS-REFERENCE TO RELATED APPLICATION

This application claims the benefit of U.S. Provisional Patent Application No. 63/461,919 filed on Apr. 26, 2023, entitled "PATROL RIFLE HOLSTER," and also claims the benefit of U.S. Provisional Patent Application No. 63/462,321 filed on Apr. 27, 2023, entitled "PATROL RIFLE HOLSTER," which are hereby incorporated by reference in their entirety for all that is taught and disclosed therein.

FIELD OF THE INVENTION

The present invention relates to firearms, and more particularly to a firearm carrier element that supports a firearm on a wearer with increased comfort and safety.

BACKGROUND AND SUMMARY OF THE INVENTION

Rifle-armed law enforcement officers, rifle-armed security officers, military personnel, and recreational shooters have a need to comfortably carry their rifles. Although rifle slings have long been used for this purpose, they have the disadvantage of transferring the weight of a slung rifle to the user's neck, shoulders, and back, which can eventually become uncomfortable. Other prior art products attach a rifle to a wearer so that the user's hands are free and unencumbered by the rifle. However, they require an apparatus to be permanently attached to the rifle that integrates with a separately worn receptacle on the user's body or belt. These products add unnecessary parts and weight to the rifle itself, bulk to the user's body, are quite expensive, they do not keep the rifle from swaying or swinging, and they do not improve the user's or the public's safety.

Therefore, a need exists for a new and improved firearm carrier element that supports a firearm on a wearer with increased comfort and safety. In this regard, the various embodiments of the present invention substantially fulfill at least some of these needs. In this respect, the firearm carrier element according to the present invention substantially departs from the conventional concepts and designs of the prior art, and in doing so provides an apparatus primarily developed for the purpose of supporting a firearm on a wearer with increased comfort and safety.

The present invention provides an improved firearm carrier element, and overcomes the above-mentioned disadvantages and drawbacks of the prior art. As such, the general purpose of the present invention, which will be described subsequently in greater detail, is to provide an improved firearm carrier element that has all the advantages of the prior art mentioned above.

To attain this, the preferred embodiment of the present invention essentially comprises a plate having a first side configured to face the supporter and an opposed second side configured to face the firearm, a connection facility configured to connect the plate to the supporter, and an aperture configured to receive at least one of the protrusions and the operating element. The operating element may be a bolt catch lever. The operating element may be movable between a ready position when the firearm is disconnected from the carrier element and a retention position when the firearm is connected to the carrier element. The operating element may be spring biased. The plate may include a ramp surface adjacent the aperture and configured to move the operating element in response to connection of the firearm to the carrier element.

There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
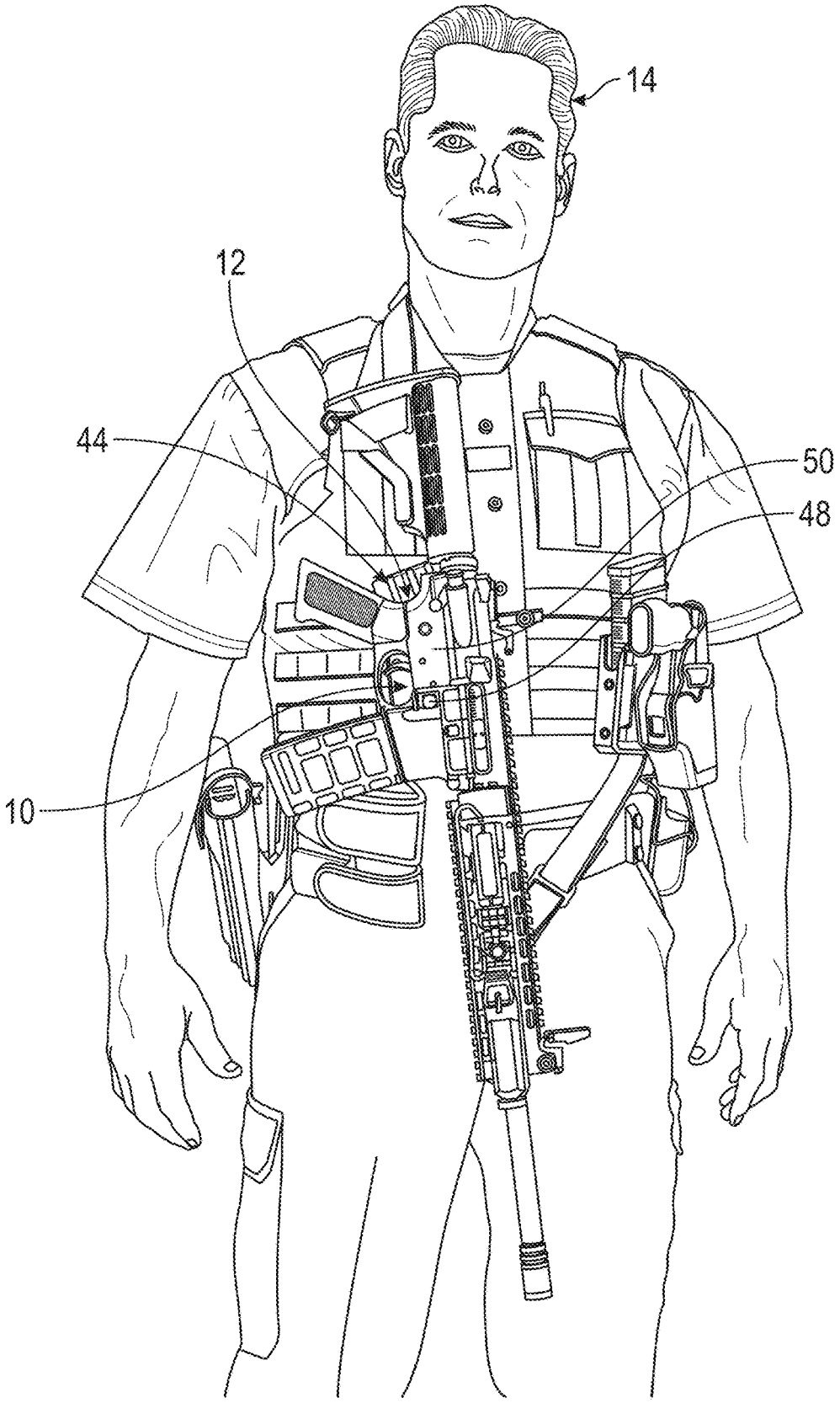
FIG. 1 is a top view of the current embodiment of a firearm carrier element constructed in accordance with the principles of the present invention in use connecting a firearm to a wearer.

An embodiment of the firearm carrier element of the present invention is shown and generally designated by the reference numeral 10.

Figure 2:
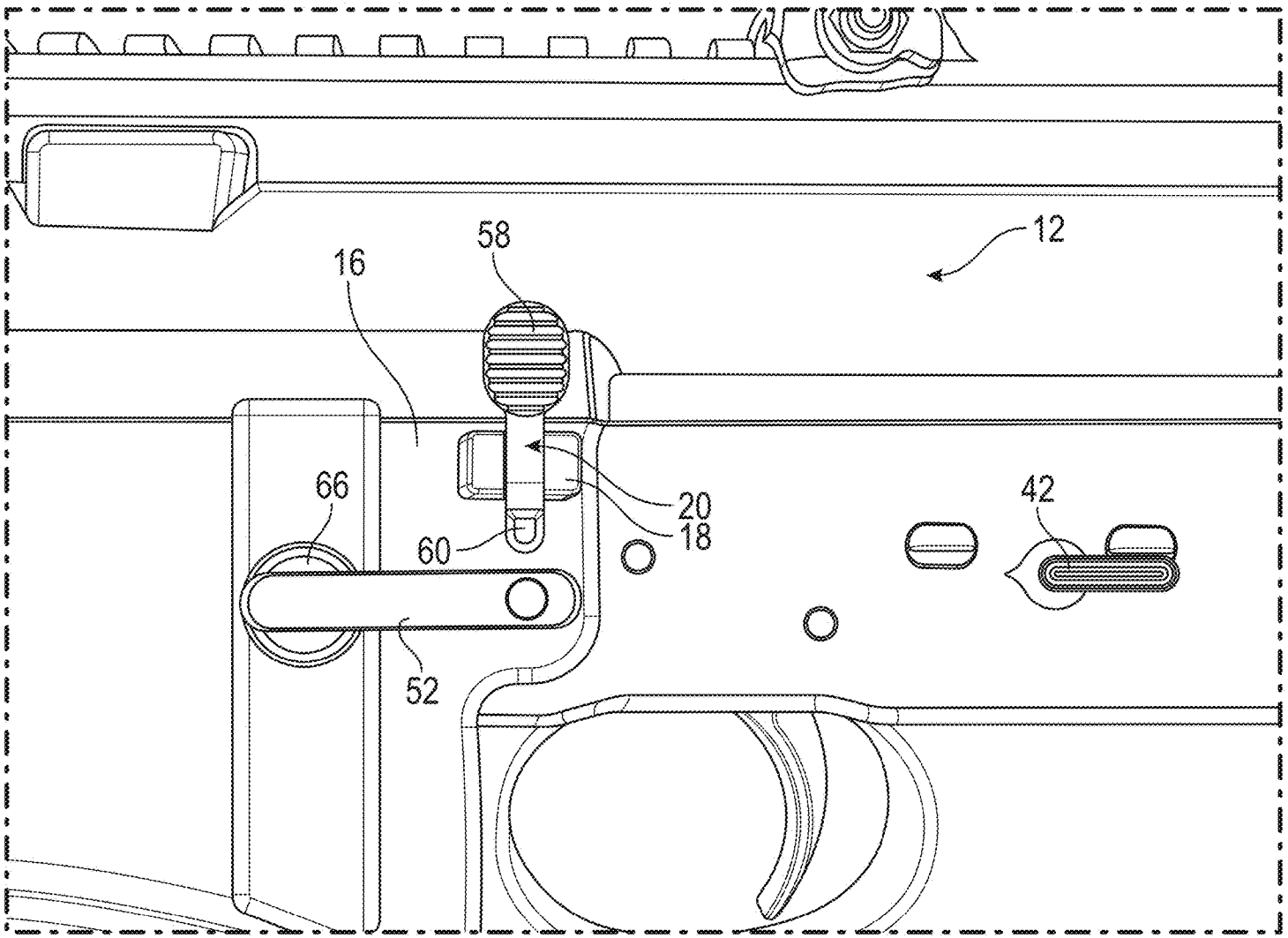
FIG. 2 is an enlarged fragmentary side view of the firearm of FIG. 1 detached from the firearm carrier element.
Figure 3:
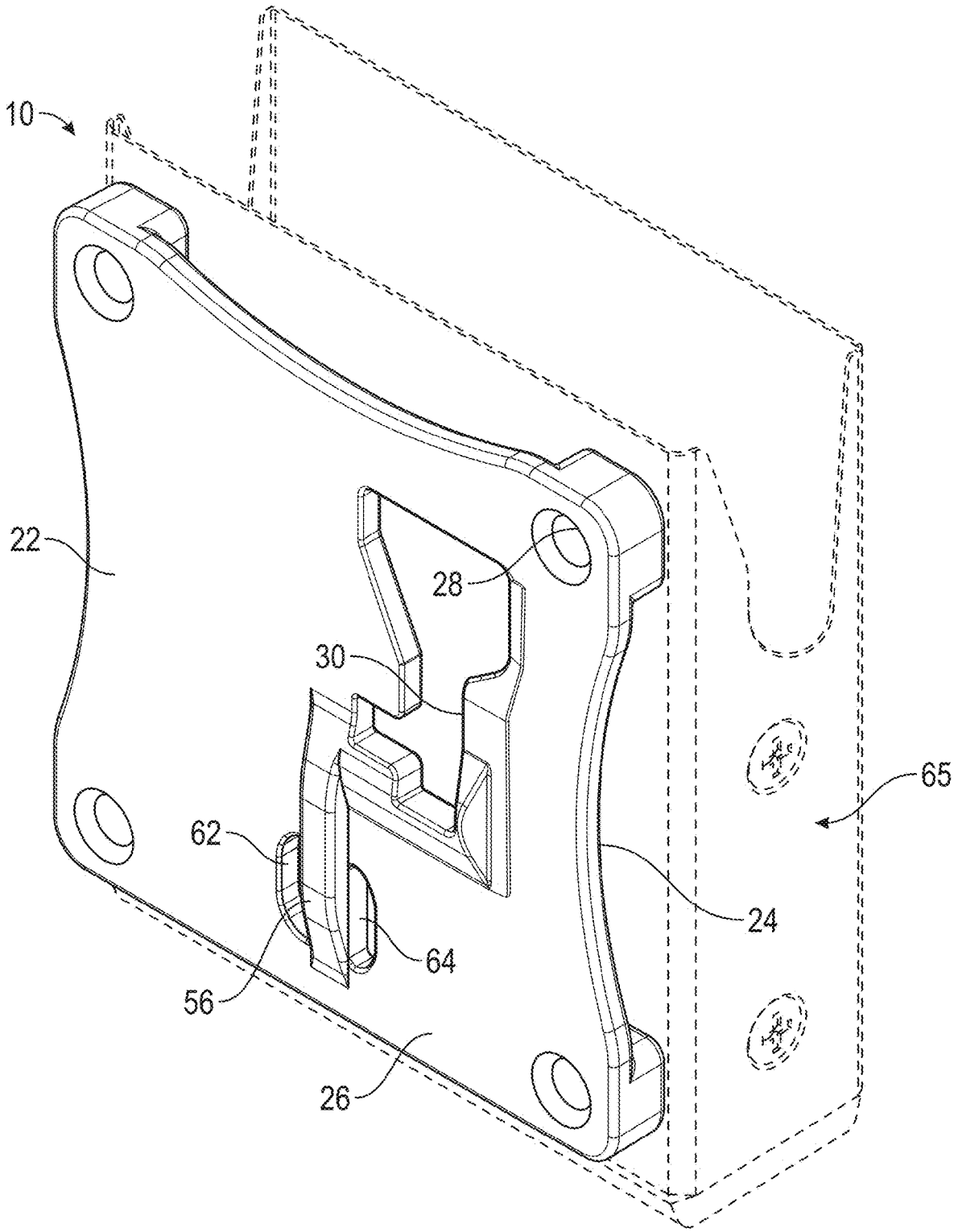
FIG. 3 is a top isometric view of the firearm carrier element of FIG. 1.
Figure 8:
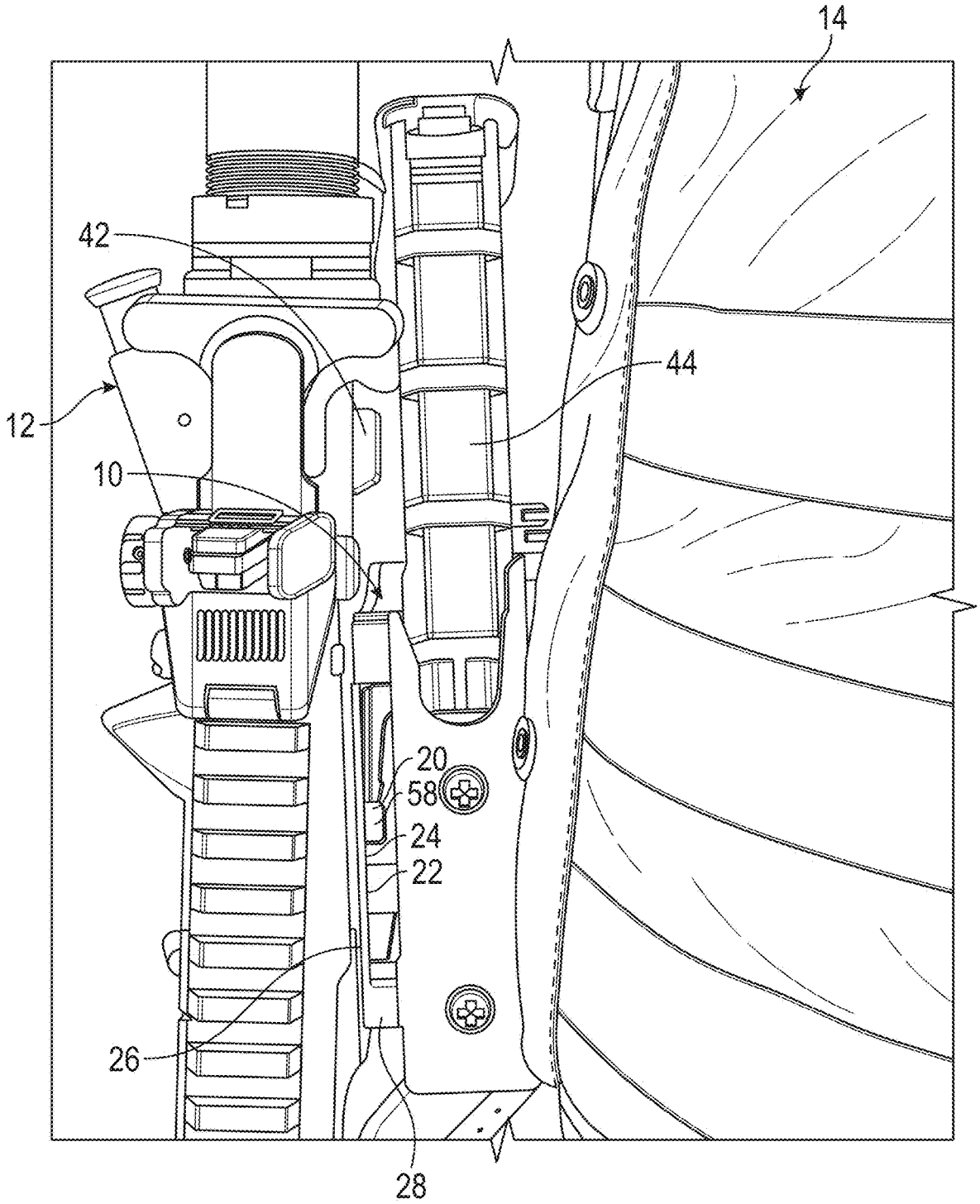
FIG. 8 is a side view of the firearm carrier element of FIG. 1 in use connecting a firearm to a wearer.

FIGS. 1, 3 & 8 illustrate the improved firearm carrier element 10 of the present invention. FIG. 2 illustrates a firearm 12 suitable for use with the firearm carrier element. More particularly, FIGS. 1 & 8 show the firearm carrier element in use supporting the firearm on a supporter 14. In the current embodiment, the firearm is an AR-15, M-4, or M-16 rifle having a body surface 16 with a protrusion 18 supporting an operating element 20. The firearm carrier element has a plate 22 having a first side 24 configured to face the supporter and an opposed second side 26 configured to face the firearm. The supporter may be a person or wearer, or may be a structure such as a wall or interior of a patrol vehicle to which a rifle may be mounted for ready access. The plate includes a connection facility 28 configured to connect the plate to the wearer. The plate also defines an aperture 30 configured to receive at least one of the protrusions and the operating element on the firearm. When the firearm 12 has a non-ambidextrous safety selector lever 42 and the firearm carrier element 10 is used in conjunction with a Patrol Rifle Integrated Magazine Pouch 65 and a rifle magazine 44, the magazine 44 overlays the safety selector lever reducing the possibility of inadvertent actuation.

In the current embodiment, the operating element 20 is a bolt catch or bolt hold-open lever. The operating element is movable between a ready position when the firearm 12 is disconnected from the firearm carrier element 10 and a retention position when the firearm is connected to the firearm carrier element. The operating element may be spring biased.

The protrusion 18 is an oblong element in the current embodiment. The protrusion is a pivot pin block (housing) of an AR-15, M-4, or M-16 rifle, with the pivot pin block pivotally supporting the bolt catch lever serving as the operating element 20.

Figure 4:
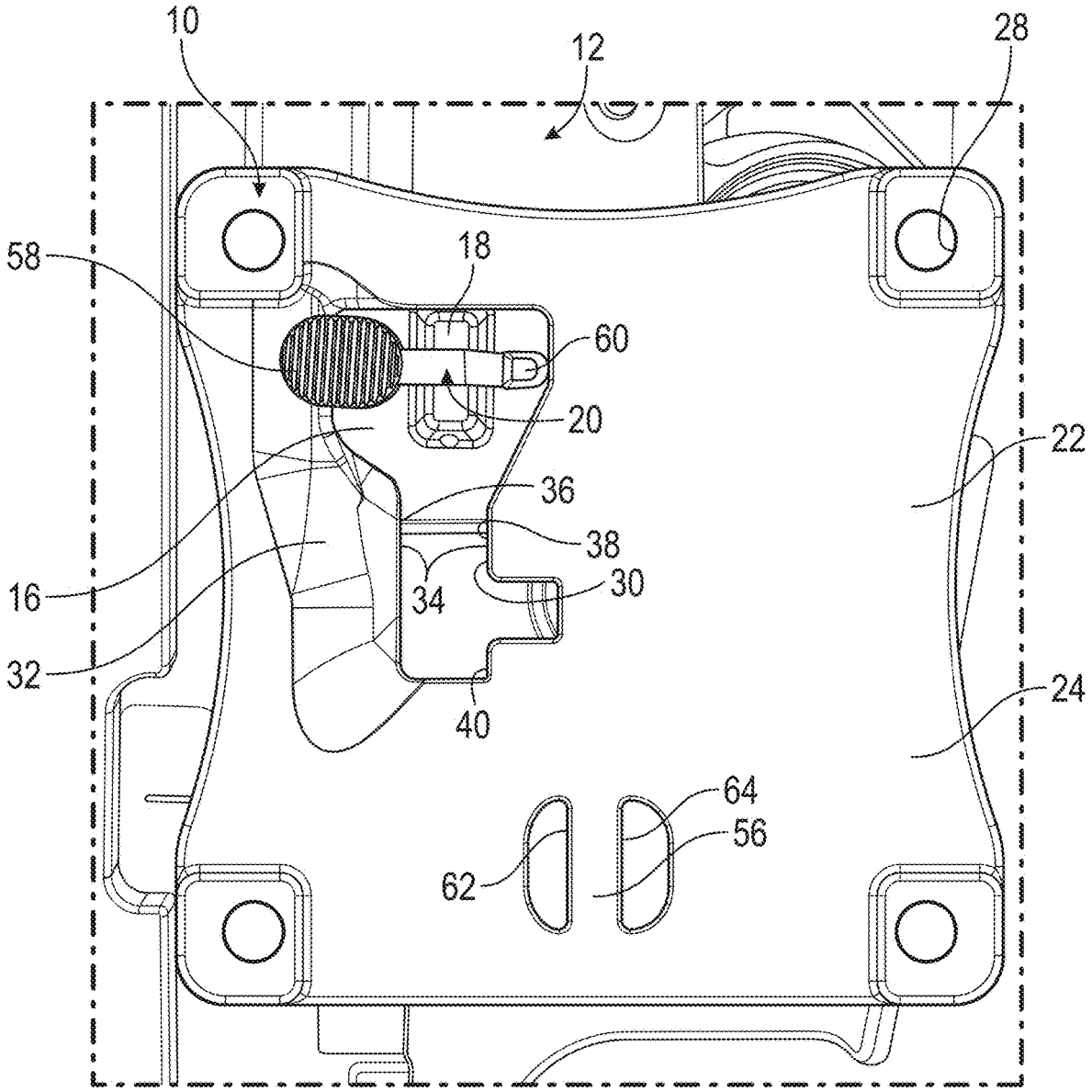
FIG. 4 is a rear enlarged view of the firearm carrier element of FIG. 1 with the operating element and protrusion initially inserted into the aperture.
Figure 5:
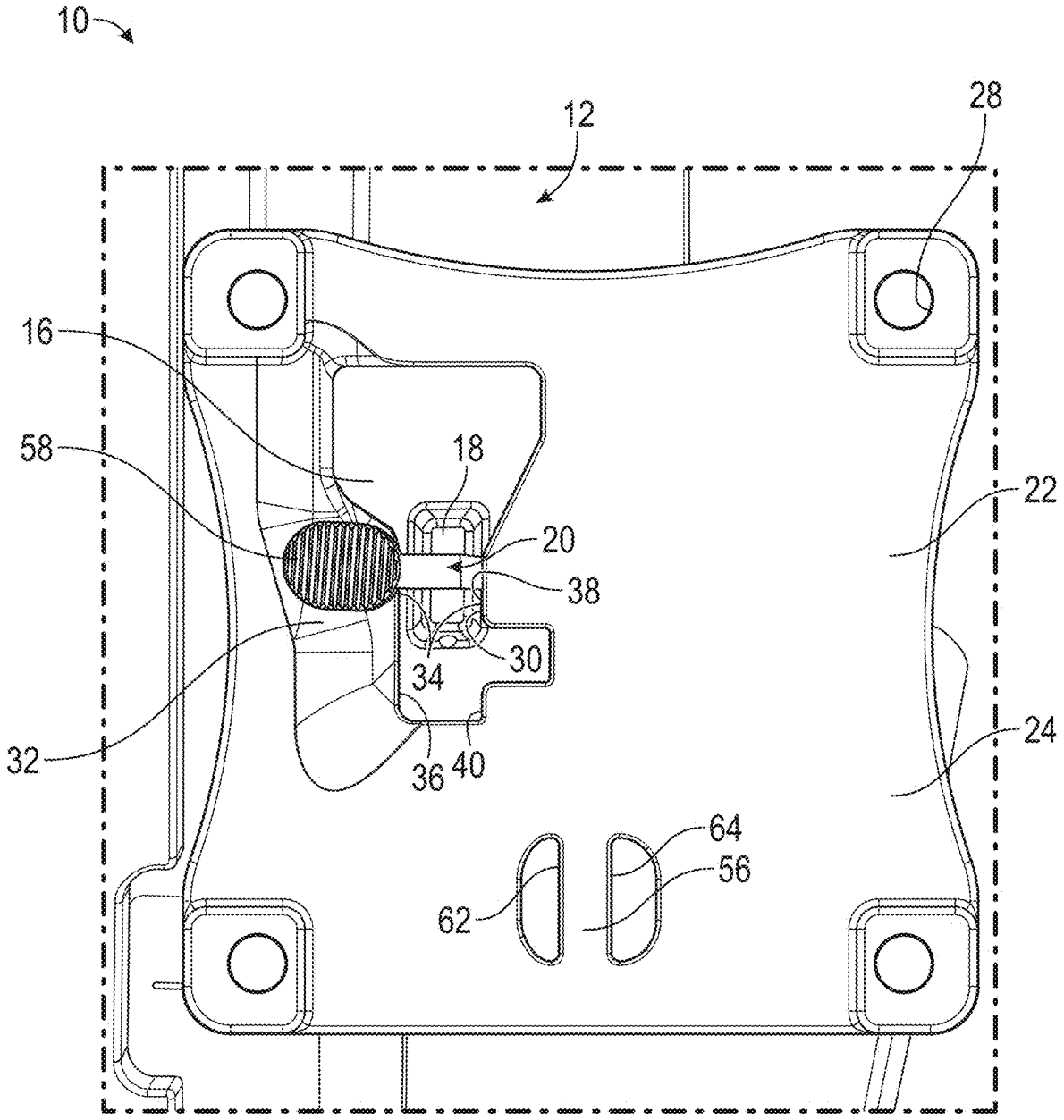
FIG. 5 is a rear enlarged view of the firearm carrier element of FIG. 1 with the operating element and protrusion having moved downward relative to FIG. 4.
Figure 6:
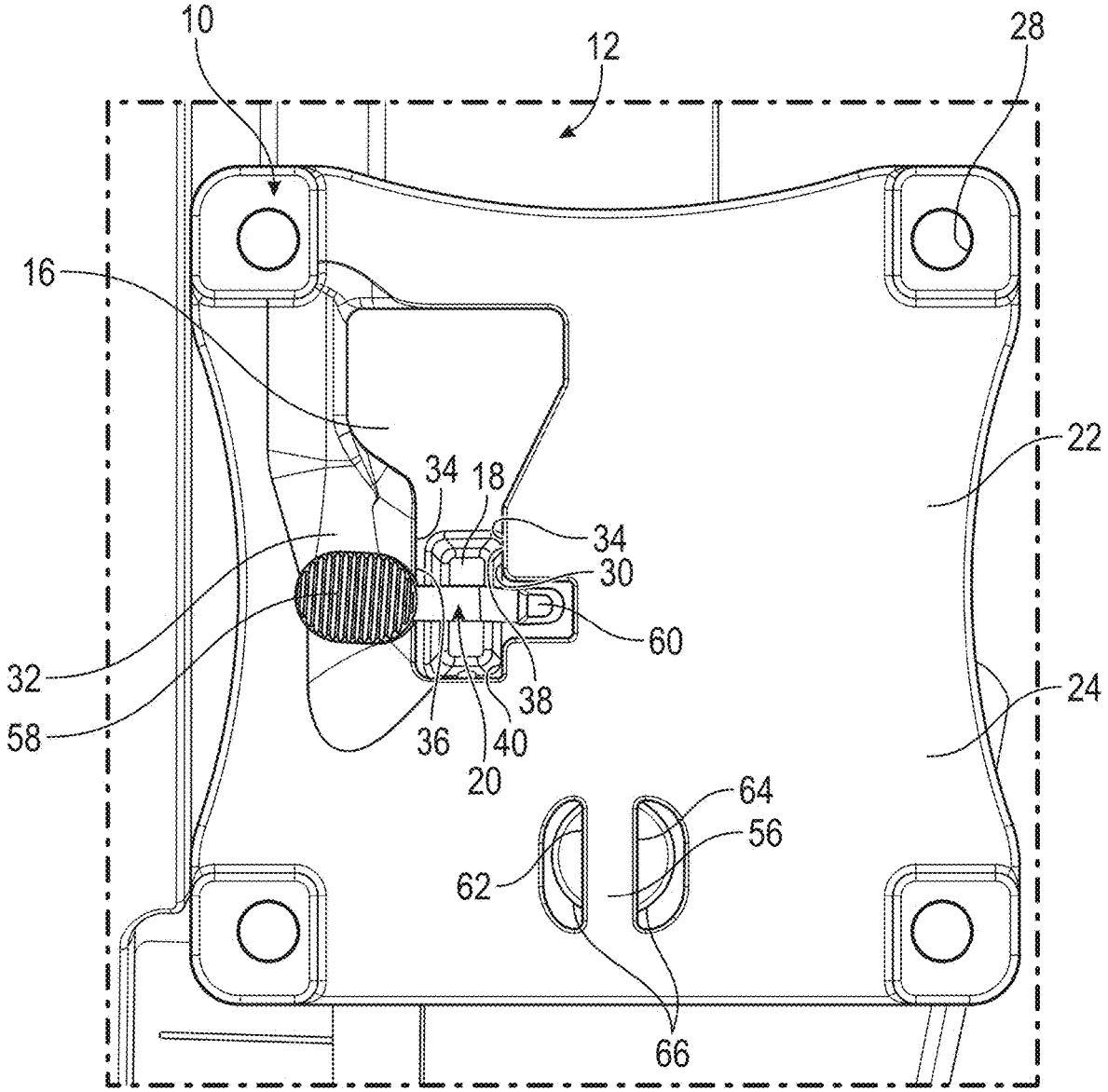
FIG. 6 is a rear enlarged view of the firearm carrier element of FIG. 1 with the operating element and protrusion having moved downward relative to FIG. 5 such that the protrusion is received in the slot portion of the aperture.
Figure 7A:
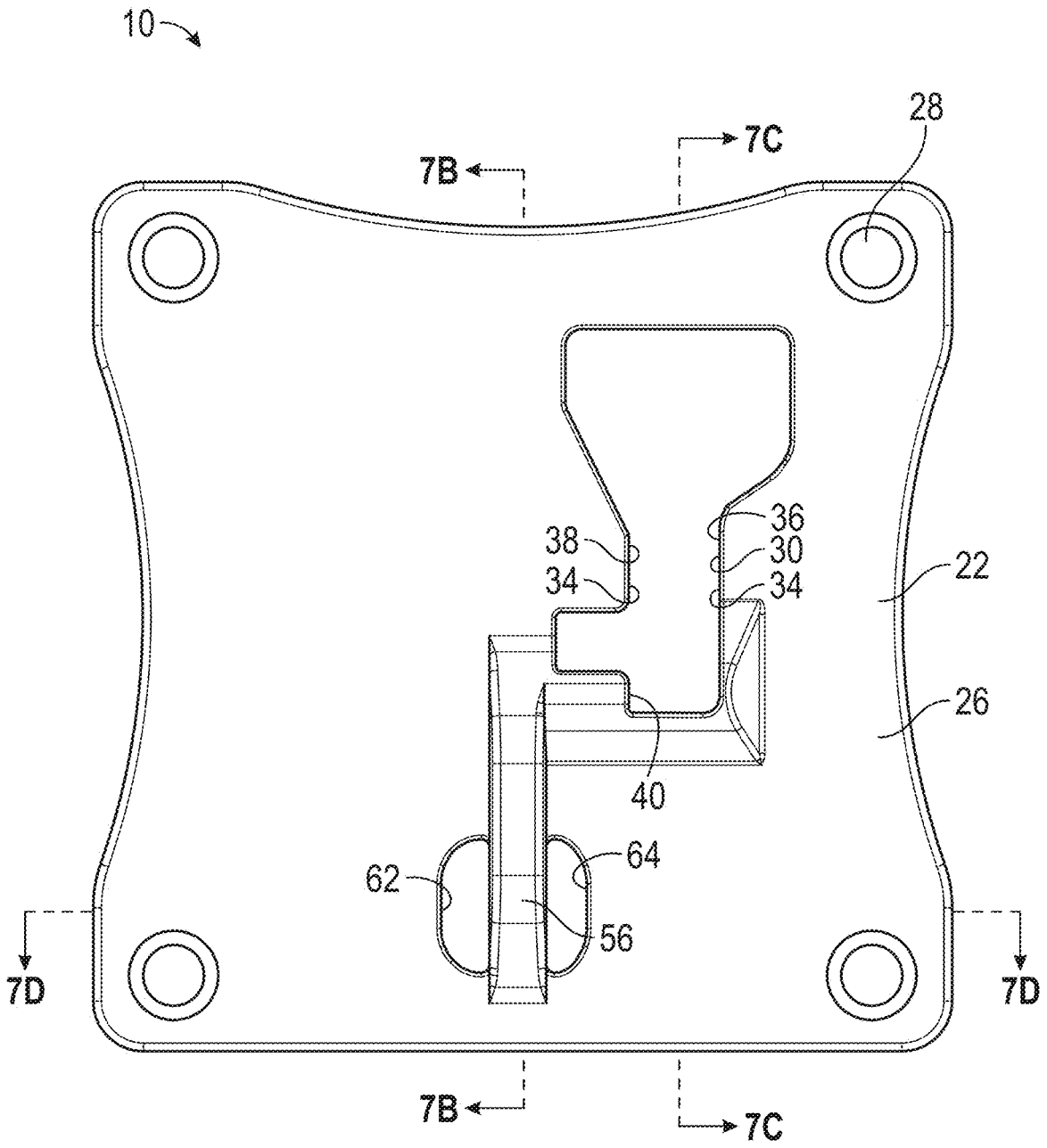
FIG. 7A is a front enlarged view of the firearm carrier element of FIG. 1.
Figure 7B:
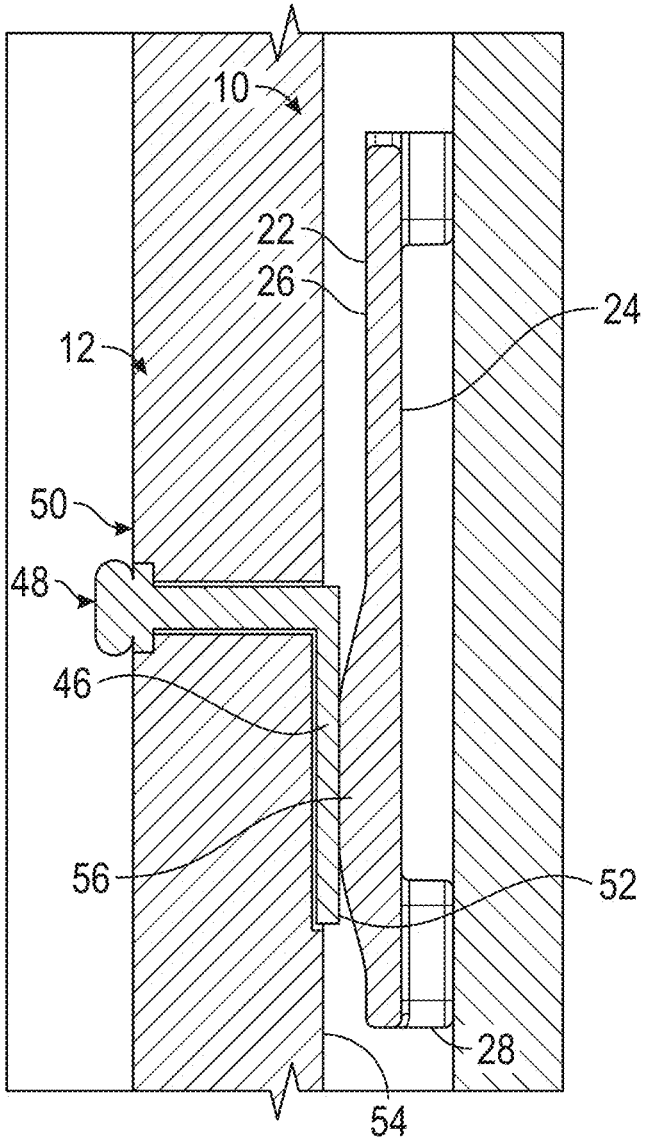
FIG. 7B is an enlarged side sectional view taken along line 7B-7B of FIG. 7A.
Figure 7C:
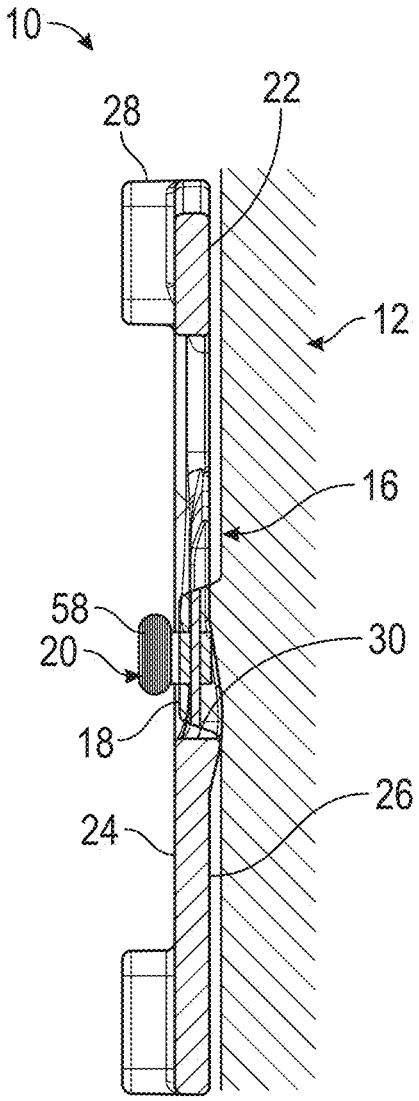
FIG. 7C is an enlarged side sectional view taken along line 7C-7C of FIG. 7A.
Figure 7D:
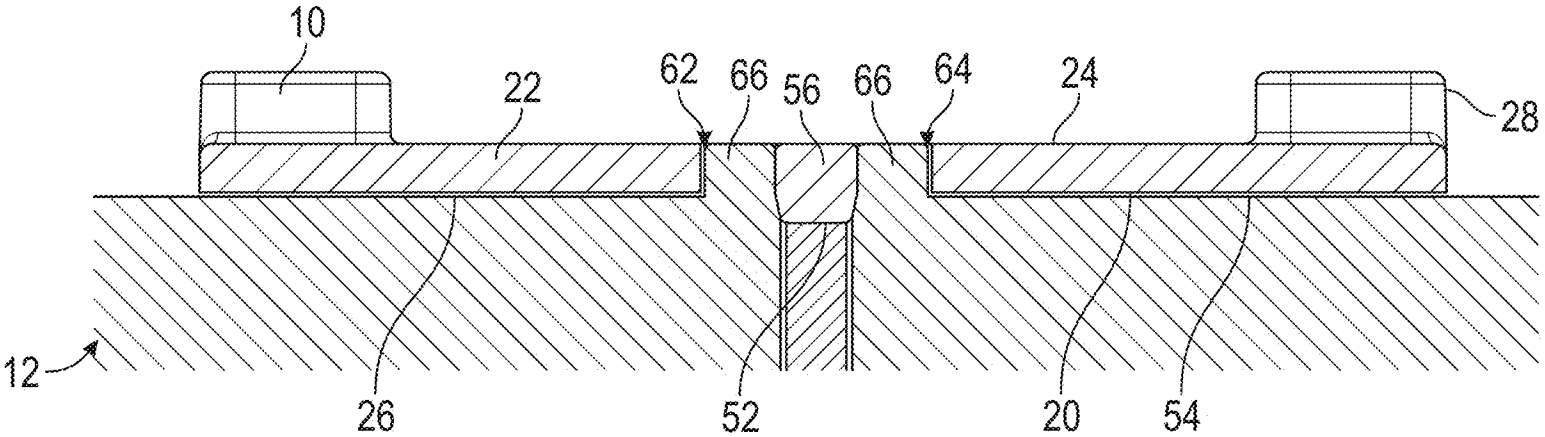
FIG. 7D is an enlarged side sectional view taken along line 7D-7D of FIG. 7A.

FIGS. 4-6 illustrate the improved firearm carrier element 10 of the present invention. More particularly, FIGS. 4-6 show how the firearm 12 is connected to the firearm carrier element by the operating element 20 and protrusion 18. The plate 22 includes a ramp surface 32 adjacent the aperture 30 that is configured to move the operating element in response to connection of the firearm 12 to the firearm carrier element 10. The aperture includes an anti-rotation surface 34 configured to limit rotation of the firearm with respect to the plate. The anti-rotation surface includes opposed parallel walls 36, 38. The ramp surface lifts the top 58 of the operating element so the bottom 60 of the operating element is pivoted downward so the bottom of the operating element does not obstruct the passage of the protrusion between the opposed parallel walls of the anti-rotation surface. The aperture is configured to receive the operating element by first orienting the firearm muzzle down, then moving the firearm laterally to insert the operating element into the aperture, then shifting the firearm in the downward direction. Shifting the firearm in the downward direction includes positioning the protrusion in a slot portion 40 of the aperture. These steps are reversed to release the firearm from the firearm carrier element.

FIGS. 7A-7D illustrate the improved firearm carrier element 10 of the present invention. More particularly, FIGS. 7A, B & D show how the firearm carrier element interacts with the magazine release actuator 46 on the firearm when the firearm is connected to the firearm carrier element. The magazine release actuator has an actuator 48 on a first side 50 of the firearm, and an end portion 52 on a second side 54 of the firearm and facing the plate 22. When the firearm is connected to the firearm carrier element, a magazine release block portion 56 of the plate overlays the end portion of the magazine release actuator to prevent inadvertent actuation of the magazine release actuator. The magazine release block portion protrudes from the plate. There are two half-moon apertures 62, 64 on either side of the magazine release block portion. The magazine release actuator housing 66 on the firearm is received in the two half-moon shaped apertures, which prevents the firearm from swaying or twisting when connected to the firearm carrier element.

It should be appreciated that the firearm carrier element 10 allows the wearer 14 to hang the firearm 12 by the bolt catch lever and pivot pin block (housing). Thus, the firearm carrier element does not require any modifications to the firearm or the attachment of anything extra to the firearm because the firearm's own parts (bolt catch lever, pivot pin block, and magazine release button housing) attach the firearm to the plate 22. The top 58 of the operating element/bolt catch lever is slid into and under the plate and then pushed downward by the wearer. The opposite side of the plate engages the bottom of the bolt catch lever, causing the top of the bolt catch lever to open wider. This additional opening creates space between the backside of the top of the bolt catch lever and the plate, allowing the entire bolt catch lever and pivot pin block to easily move downward and fully seat the plate upon the pivot pin block, bolt catch lever, and the magazine release actuator housing. Most of the firearm's weight then rests upon the firearm carrier element 10 via the pivot pin block (housing). In addition, the center of the two halfmoon shaped protrusions of the magazine release actuator housing snap into the plate, preventing the firearm from twisting left and right. This also prevents the wearer from accidentally dropping the magazine as the magazine release actuator becomes more difficult to completely depress when fully seated into the plate.

The firearm carrier element provides the wearer with relief while carrying a slung firearm by transferring some of the weight of the slung firearm from the wearer's neck, shoulders and back to the firearm carrier element worn on the wearer's chest. By securing the firearm when not immediately needed, just as law enforcement officers and military personnel do with their pistols, rifle-armed personnel can more comfortably work static posts or walk amongst crowds in a manner that may be viewed by the public as less aggressive or militaristic. While the firearm is secured, the barrel remains pointed at the ground, and the wearer's hands are generally off the rifle and free to use as they desire for everyday tasks such as using their radio or cell phone, taking notes, eating, drinking, conversing, and interacting with the public. This softer approach to the deployment of the rifle still ensures that rifle armed personnel have the tool they may need to protect the public or themselves at a moment's notice. The increased comfort provided by the firearm carrier element makes rifle armed personnel more apt to take a rifle with them more often (when appropriate) than they might otherwise when responding to calls or providing security at festivals, parades, and athletic events. The firearm carrier element also increases the public's comfort with patrol rifles because they are pointed downwards and do not have to be gripped by the wearer.

In addition, the firearm carrier element 10 helps take safety in the training environment to a new level. Once the AR-15, M-4 or M-16 rifle has its bolt locked open and to the rear, and the rifle is fully seated into the firearm carrier element, the rifle's open action is easy to see in daylight conditions for other trainees or safety inspectors. Furthermore, the bolt cannot accidentally slam close and create a safety hazard because the top of the bolt catch lever cannot be depressed. The firearm carrier element can also be used as a storage device for firearms by mounting the plate 22 to a hard surface such as a wall.

It should be appreciated that the firearm carrier element 10 is ambidextrous and can be used by left-handed shooters. When the rifle is inserted into the firearm carrier element and the bolt is locked to the rear (held open), the bolt cannot be sent forward into battery, either on purpose or by accident. Securing the bolt makes it very easy for instructors to visually check and clear a line of shooters. Furthermore, because the rifle's muzzle is secured in a downward position when the rifle is inserted into the firearm carrier element, both training and operational environments become safer. The firearm carrier element maintains control of the inserted rifle without requiring use of the wearer's hands. Rifle awareness is maintained because the rifle is held in front of the user's body within their view.

The firearm carrier element 10 is preferably an injection molded polymer product made to provide the various apertures. The firearm carrier element is preferably used with an existing product called the Patrol Rifle Integrated Magazine Pouch manufactured by Center Mass, Inc. of Livonia, MI, which is disclosed in U.S. Pat. Nos. 8,231,038 and 8,733,606, and U.S. Design Pat. No. D624,149. Alternative embodiments could be suitable for use without the Patrol Rifle Integrated Magazine Pouch. For example, the firearm carrier element could be attached directly to a Molle vest, gun belt, or other soft or hard surfaces using alternative shapes or materials other than polymer. Likewise, a retention device similar to devices found in some pistol holsters could be added. Furthermore, although the firearm carrier element is currently intended to be used as a supplement or in conjunction with a firearm sling for transport and deployment of a firearm, future adaptations could replace a firearm sling.

In the context of the specification, the terms "rear" and "rearward," and "front" and "forward," have the following definitions: "rear" or "rearward" means in the direction away from the muzzle of the firearm while "front" or "forward" means it is in the direction towards the muzzle of the firearm.

While a current embodiment of a firearm carrier element has been described in detail, it should be apparent that modifications and variations thereto are possible, all of which fall within the true spirit and scope of the invention. Although rifles have been disclosed, the firearm carrier element is also suitable for use with shotguns, light and medium machine guns, and other firearms. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firearm carrier facility for supporting a firearm on a supporter, comprising:

a firearm having a body surface with a protrusion supporting an operating element a carrier element comprising a plate having a first side configured to face the supporter and an opposed second side configured to face the firearm;

the carrier element having a connection facility configured to connect the plate to the supporter;

the carrier element defining an aperture configured to receive at least one of the protrusion and the operating element;

wherein the aperture includes an anti-rotation surface configured to limit rotation of the firearm with respect to the plate; and wherein the operating element is a bolt catch lever.

2. The carrier facility of claim 1 wherein the operating element is spring biased.

3. The carrier facility of claim 1 wherein the plate includes a ramp surface adjacent the aperture and configured to move the operating element in response to connection of the firearm to the carrier element.

4. The carrier facility of claim 1 wherein the anti-rotation surface includes opposed parallel walls.

5. The carrier facility of claim 1 wherein the protrusion is an oblong element.

6. The carrier facility of claim 1 wherein the aperture is configured to receive the operating element by first orienting the firearm muzzle down, then moving the firearm laterally to insert the operating element into the aperture, then shifting the firearm in the downward direction.

7. The carrier facility of claim 1 wherein shifting the firearm in the downward direction includes positioning the protrusion in a slot portion of the aperture.

8. The carrier facility of claim 1 wherein the supporter is a person.

9. The carrier facility of claim 1 wherein the operating element is movable.

10. The carrier facility of claim 9 wherein the operating element is movable between a ready position when the firearm is disconnected from the carrier element and a retention position when the firearm is connected to the carrier element.

11. A firearm carrier facility for supporting a firearm on a supporter, comprising:

a firearm having a body surface with a protrusion supporting an operating element a carrier element comprising a plate having a first side configured to face the supporter and an opposed second side configured to face the firearm;

the carrier element having a connection facility configured to connect the plate to the supporter;

the carrier element defining an aperture configured to receive at least one of the protrusion and the operating element;

wherein the aperture includes an anti-rotation surface configured to limit rotation of the firearm with respect to the plate; and wherein the protrusion is a pivot pin block of an AR-15-pattern rifle, the pivot pin block pivotally supporting a bolt catch lever serving as the operating element.

12. A firearm carrier facility for supporting a firearm on a supporter, comprising:

a firearm having a body surface with a protrusion supporting an operating element a carrier element comprising a plate having a first side configured to face the supporter and an opposed second side configured to face the firearm;

the carrier element having a connection facility configured to connect the plate to the supporter;

the carrier element defining an aperture configured to receive at least one of the protrusion and the operating element;

wherein the aperture includes an anti-rotation surface configured to limit rotation of the firearm with respect to the plate; and wherein the firearm has a magazine release actuator having an actuator on a first side of the firearm, and an end portion on a second side of the firearm and facing the plate, and when the firearm is connected to the carrier element, a magazine release block portion of the plate overlays the end portion of the magazine release actuator to prevent inadvertent actuation of the magazine release actuator.

* * * * *